US009364385B2

(12) United States Patent
Yang

(10) Patent No.: US 9,364,385 B2
(45) Date of Patent: Jun. 14, 2016

(54) MASSAGE APPARATUS

(71) Applicant: Tsung-Hsun Yang, Taichung (TW)

(72) Inventor: Tsung-Hsun Yang, Taichung (TW)

( * ) Notice: Subject to any disclaimer, the term of this patent is extended or adjusted under 35 U.S.C. 154(b) by 499 days.

(21) Appl. No.: 13/892,638

(22) Filed: May 13, 2013

(65) Prior Publication Data

US 2014/0336549 A1 Nov. 13, 2014

(51) Int. Cl.
*A61H 7/00* (2006.01)

(52) U.S. Cl.
CPC ..... *A61H 7/007* (2013.01); *A61H 7/004* (2013.01); *A61H 2201/0165* (2013.01); *A61H 2201/0192* (2013.01); *A61H 2201/1215* (2013.01); *A61H 2201/149* (2013.01); *A61H 2201/164* (2013.01); *A61H 2201/1619* (2013.01); *A61H 2201/1623* (2013.01); *A61H 2201/1669* (2013.01); *A61H 2201/1671* (2013.01); *A61H 2203/0406* (2013.01); *A61H 2203/0425* (2013.01); *A61H 2205/081* (2013.01); *A61H 2205/084* (2013.01); *A61H 2205/10* (2013.01)

(58) Field of Classification Search
CPC ..... A61H 7/004; A61H 7/007; A61H 23/00; A61H 23/02; A61H 23/0263; A61H 39/00; A61H 2201/149; A61H 2201/1619; A61H 2201/1623; A61H 2201/1669; A61H 2201/1671; A61H 2205/081
See application file for complete search history.

(56) References Cited

U.S. PATENT DOCUMENTS

| | | | | |
|---|---|---|---|---|
| 4,604,993 | A * | 8/1986 | Moriwaki | A61H 23/0263 601/18 |
| 5,728,051 | A * | 3/1998 | Chi | A61H 7/004 601/112 |
| 6,283,928 | B1 * | 9/2001 | Wang | A61H 15/0078 601/101 |
| 6,790,190 | B2 * | 9/2004 | Marcantoni | A61H 15/0078 601/100 |
| 6,866,644 | B1 * | 3/2005 | Kost | A61H 23/02 601/49 |
| 7,022,091 | B2 * | 4/2006 | Chen | A61H 7/004 601/100 |
| 8,105,253 | B2 * | 1/2012 | Chen | A61H 7/004 601/112 |
| 2002/0082534 | A1 * | 6/2002 | Jikiba | A61H 15/0078 601/99 |
| 2003/0199796 | A1 * | 10/2003 | Yamazaki | A61H 7/00 601/87 |
| 2005/0113636 | A1 * | 5/2005 | Tucker | A61H 19/44 600/38 |
| 2008/0039751 | A1 * | 2/2008 | Yang | A61H 39/04 601/101 |
| 2009/0270778 | A1 * | 10/2009 | Wu | A61H 7/007 601/97 |
| 2010/0286569 | A1 * | 11/2010 | Nagano | A61H 1/008 600/587 |
| 2011/0218465 | A1 * | 9/2011 | Yang | A61H 1/00 601/18 |
| 2012/0316478 | A1 * | 12/2012 | Inada | A61H 7/007 601/126 |

FOREIGN PATENT DOCUMENTS

EP 20100153605 A1 8/2011

* cited by examiner

*Primary Examiner* — Justine Yu
*Assistant Examiner* — Kathrynn Lyddane
(74) *Attorney, Agent, or Firm* — Harness, Dickey & Pierce, PLC

(57) ABSTRACT

A massage apparatus includes an upright support frame and a moving seat. Each of the support frame and the moving seat has a U-shaped cross-section. The support frame has a middle main wall formed with an elongated groove, and two side walls extending rearwardly away from the main wall. The moving seat is connected slidably to guide rails disposed on the support frame, and has a middle plate that faces closely toward a rear surface of the main wall of the support frame, and two side plates that extend rearwardly similar to the side walls of the support frame. A massage unit includes a massage motor connected to the moving seat, a rotating shaft projecting forwardly through the elongated groove, and a head portion connected to the rotating shaft.

10 Claims, 8 Drawing Sheets

MASSAGE APPARATUS

BACKGROUND OF THE INVENTION

1. Field of the Invention

The invention relates to a massage apparatus, more particularly to a low-noise massage apparatus.

2. Description of the Related Art

Referring to FIG. 1, European Patent Application No. EP20100153605 discloses a conventional massage apparatus including an upright support frame 91, a casing 92, a moving unit 93, a massage unit 94, and a protection belt 95. The casing 92 includes a base wall 921, a surrounding wall 922 extending upwardly from a periphery of the base wall 921, and an upright elongated groove 923 formed in the surrounding wall 922. The support frame 91 is disposed in the casing 92 with a lower end thereof connected fixedly to the base wall 921, and has a U-shaped cross-section opening toward the elongated groove 923.

The moving unit 93 includes a pair of upright guide rails 931 mounted on the support frame 91, a moving plate 932 engaging slidably the guide rails 931, and a driving motor 933 for driving the moving plate 932 to move upwardly or downwardly along the guide rails 931.

The massage unit 94 includes a massage motor 943 disposed co-movably on the moving plate 932 and having a rotating shaft 942 that extends through the elongated groove 923 and that projects out of the casing 92, and a head piece 941 connected eccentrically to the rotating shaft 942 and driven by the massage motor 943 to rotate eccentrically.

The protection belt 95 is connected co-movably to the moving plate 932 and covers the elongated groove 923 to prevent insertion of fingers of a user and possible injury of the fingers. The rotating shaft 942 extends through the protection belt 95.

Although the conventional massage apparatus is capable of massaging a user's body, it has several drawbacks.

1. The massage motor 943 is disposed between the support frame 91 and the moving plate 932. When the rotating head piece 941 is pressed by the user, the distance between the support frame 91 and the moving plate 932 increases the distance between a force application point and a supporting point, causing the moving plate 932 to vibrate and to generate vibrational noises.

2. The support frame 91 is connected to the casing 92 only at the lower end thereof. When a user abuts against the rotating head piece 941 of the massage unit 94 for massage, differential vibration motion is produced between the support frame 91 and the casing 92, thereby resulting in considerable noises.

3. The protection belt 95 is clamped by the surrounding wall 922 of the casing 92 and is fastened to the moving plate 932. When the conventional massage apparatus is in use, because of the differential vibration motion between the support frame 91 and the casing 92, the protection belt 95 may vibrate vigorously and may even repeatedly hit the surrounding wall 922, creating annoying noises.

4. In order to provide the support frame 91 with sufficient robustness and stability, the base wall 921 of the casing 92 must be strong enough to support the support frame 91, and the base wall 921 must therefore have relatively large area and thickness, thereby requiring a bulky and heavy structure for the casing 92.

5. The rotating head piece 941 is attached directly to the rotating shaft 942 of the massage motor 943 such that when the user presses the rotating headpiece 941, the rotating shaft 942 tends to vibrate within the elongated groove 923 and even hit the surrounding wall 922.

SUMMARY OF THE INVENTION

Therefore, the object of the present invention is to provide a low-noise massage apparatus.

Accordingly, a massage apparatus of the present invention comprises:

an upright support frame having a U-shaped cross-section and including an upright main wall that has opposite front and rear surfaces, a pair of upright side walls that are connected respectively to two opposite edges of the main wall and that extend rearwardly away from the main wall, and an upright elongated groove that is formed through the front and rear surfaces of the main wall;

a moving unit disposed in the support frame and including a pair of upright guide rails that are mounted respectively on inner surfaces of the side walls, and a moving seat that is connected slidably to the guide rails and that is movable along the guide rails, the moving seat having a middle plate that faces toward and that is close to the rear surface of the main wall, a pair of side plates that are connected respectively to two opposite ends of the middle plate and that extend rearwardly away from the middle plate, and a pair of slider members that are disposed respectively on the side plates and that engage respectively and slidably the guide rails; and a massage unit including a massage motor that is connected co-movably to the moving seat and that has a rotating shaft extending forwardly through the elongated groove, and a head portion that is connected eccentrically to and driven by the rotating shaft.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 2:
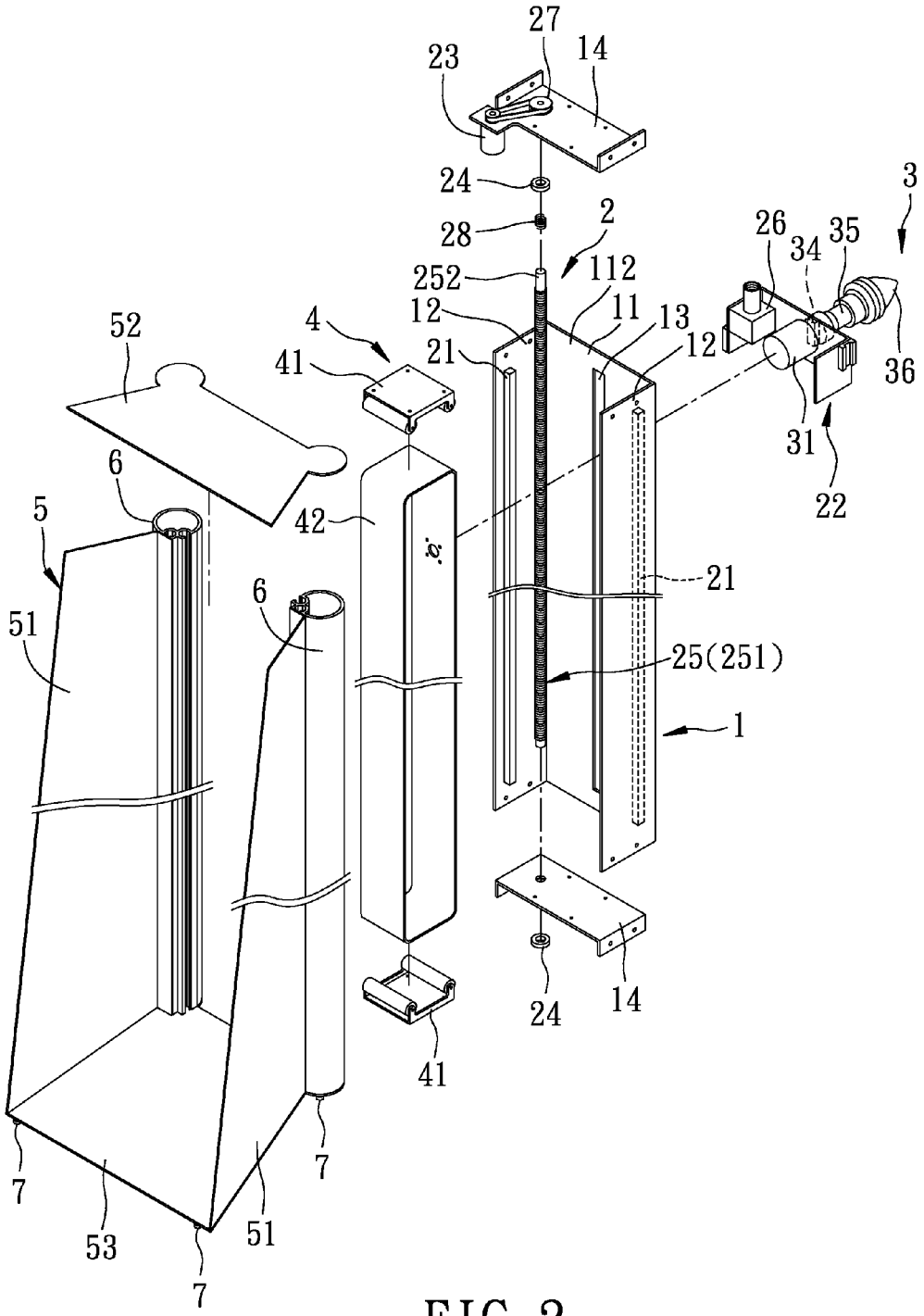
FIG. 2 is an exploded perspective view of a preferred embodiment of a massage apparatus according to the invention.
Figure 3:
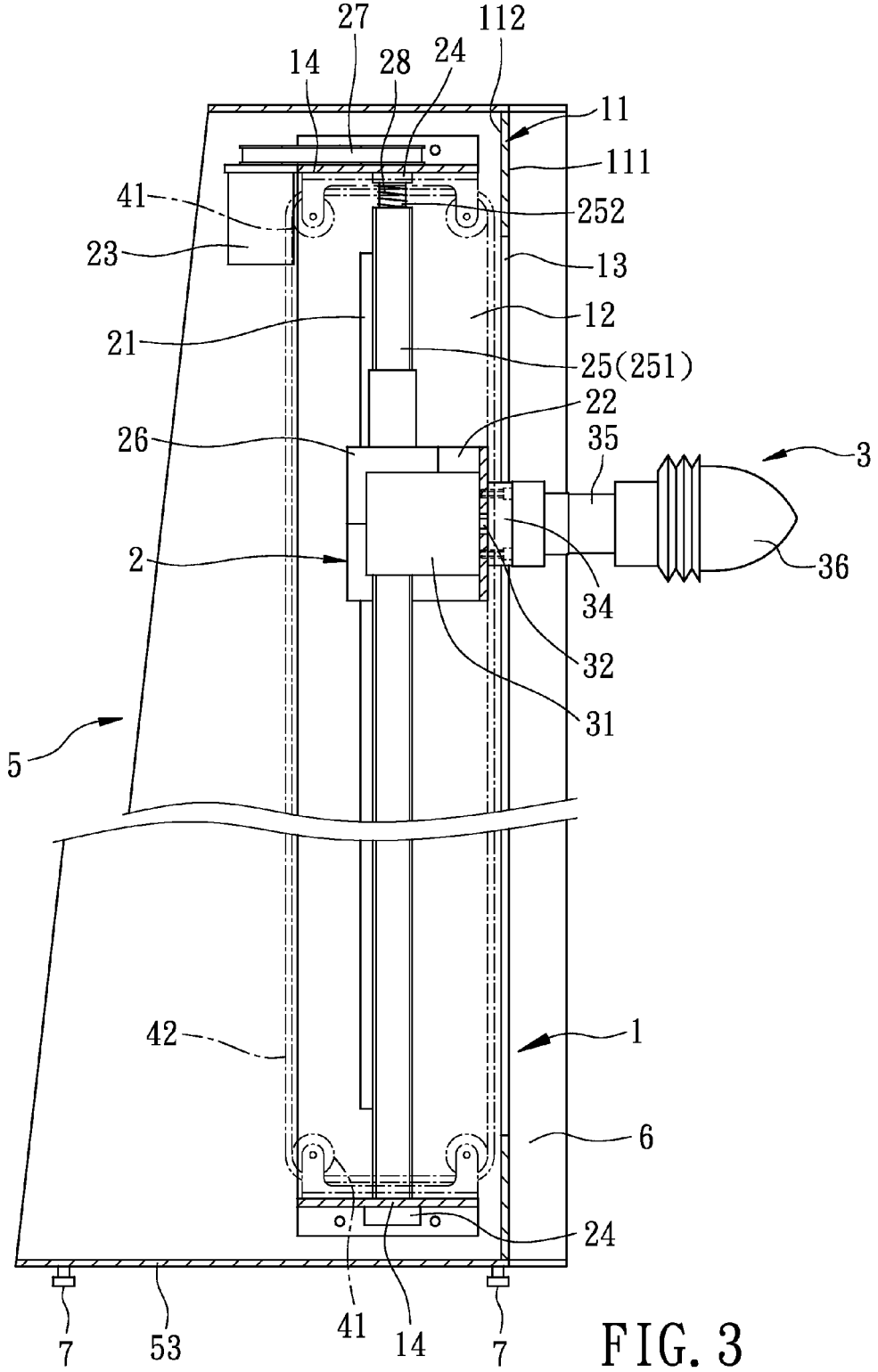
FIG. 3 is a fragmentary sectional side view of the preferred embodiment.
Figure 4:
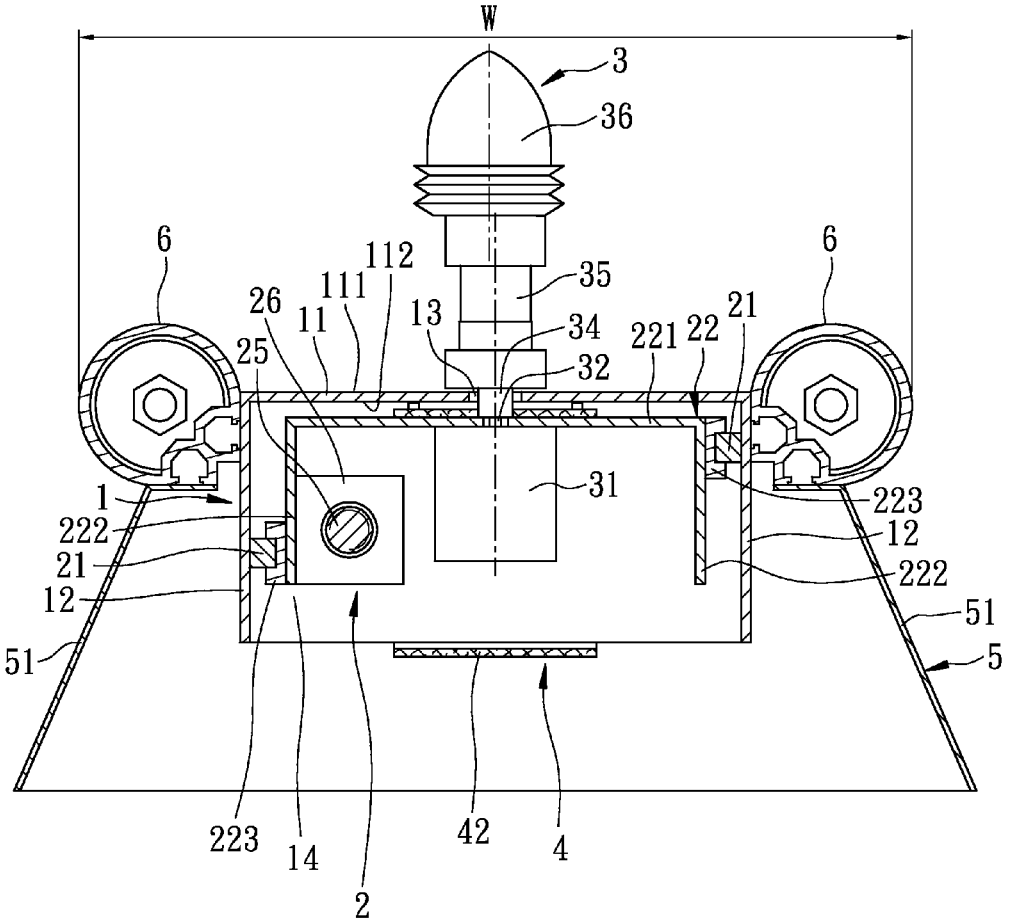
FIG. 4 is a sectional top view of the preferred embodiment.

As shown in FIGS. 2, 3 and 4, a preferred embodiment of a massage apparatus according to the present invention comprises an upright support frame 1, a moving unit 2, a massage unit 3, a protection unit 4, an outer housing 5 and a plurality of foot members 7.

The support frame 1 has a U-shaped cross-section and includes an upright main wall 11 that has opposite front and rear surfaces 111, 112, a pair of upright side walls 12 that are connected respectively to two opposite edges of the main wall 11 and that extend rearwardly away from the main wall 11, and an upright elongated groove 13 that is formed through the front and rear surfaces 111, 112 of the main wall 11. The support frame 1 further includes two end plates 14 disposed respectively above an upper end of the elongated groove 13 and below a lower end of the elongated groove 13. Each of the end plates 14 bridges and connects the side walls 12. Specifically, one of the end plates 14 bridges the upper ends of the side walls 12, and the other of the end plates 14 bridges the lower ends of the side walls 12. Preferably, the main wall 11 has a width smaller than 40 centimeters.

The moving unit 2 is disposed in the support frame 1, and includes a pair of upright guide rails 21 that are mounted respectively on inner surfaces of the side walls 12, a moving seat 22 that is connected slidably to the guide rails 21 and that is movable along the guide rails 21, a driving motor 23, two bearing members 24 that are respectively disposed in abutment with the end plates 14, an elongated screw rod 25 that is parallel to the guide rails 21, and a driven member 26 that is connected co-movably to the moving seat 22 and that is disposed engagedly around the screw rod 25.

A distance between one of the guide rails 21 and the main wall 11 is different from that between the other one of the guide rails 21 and the main wall 11.

Figure 6:
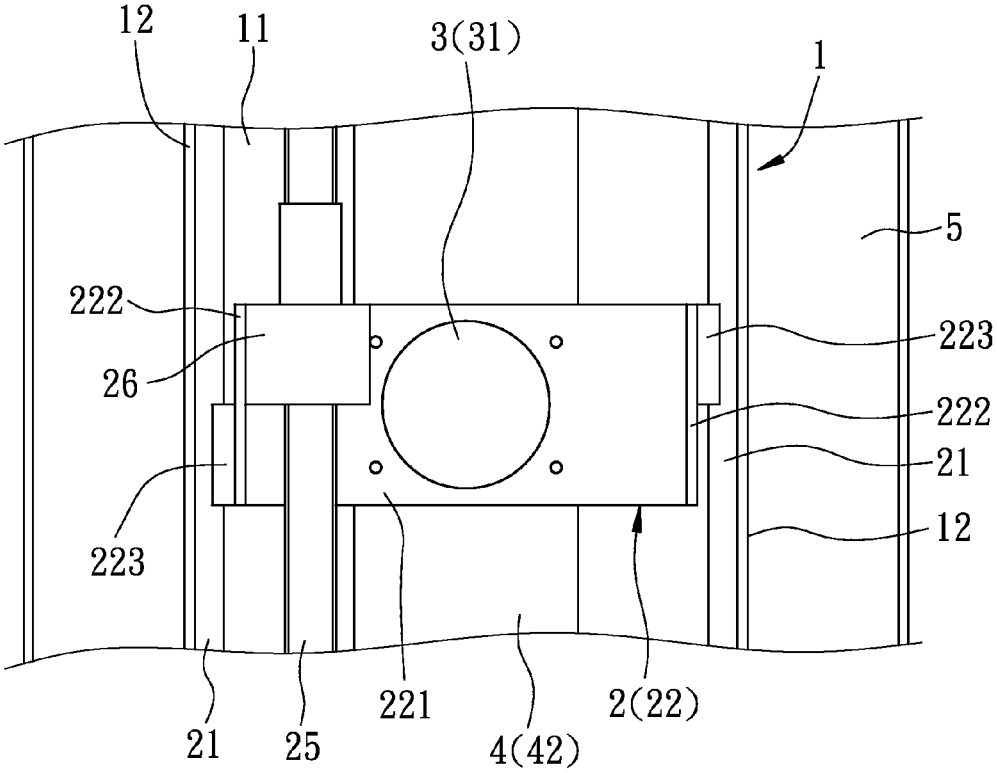
FIG. 6 is a fragmentary rear view of the preferred embodiment.

The moving seat 22 has a middle plate 221 facing toward and close to the rear surface 112 of the main wall 11, a pair of side plates 222 connected respectively to two opposite ends of the middle plate 221 and extending rearwardly away from the middle plate 221, and a pair of slider members 223 disposed respectively and co-movably on the side plates 222 and engaging respectively and slidably the guide rails 21. Further referring to FIG. 6, the slider members 223 are different in altitude.

The driving motor 23 is provided on one of the end plates 14. In this embodiment, the driving motor 23 is disposed on the upper one of the end plates 14.

The screw rod 25 is made of steel, has upper and lower ends extending through respective end plates 14 and respective bearing members 24, and is driven rotatably by the driving motor 23. One end of the screw rod 25 is linked to an output shaft of the driving motor 23 via a timing belt 27. The screw rod 25 further has an elongated threaded rod portion 251, and a non-threaded rod portion 252 connected to one end of the threaded rod portion 251. The non-threaded rod portion 252 has a diameter smaller than that of the threaded rod portion 251.

The moving unit 2 further includes a resilient member 28 sleeved on the non-threaded rod portion 252 and having opposite ends respectively abutting against the threaded rod portion 251 and a proximal one of the end plates 14. In this embodiment, the non-threaded rod portion 252 is connected to an upper end of the threaded rod portion 251, and the resilient member 28 is a compression spring.

The driving motor 23 drives rotation of the screw rod 25 through the timing belt 27. Rotation of the screw rod 25 drives the driven member 26 and the moving seat 22 to move upwardly and downwardly along the screw rod 25. In this embodiment, the driven member 26 is made of plastic steel.

Figure 5:
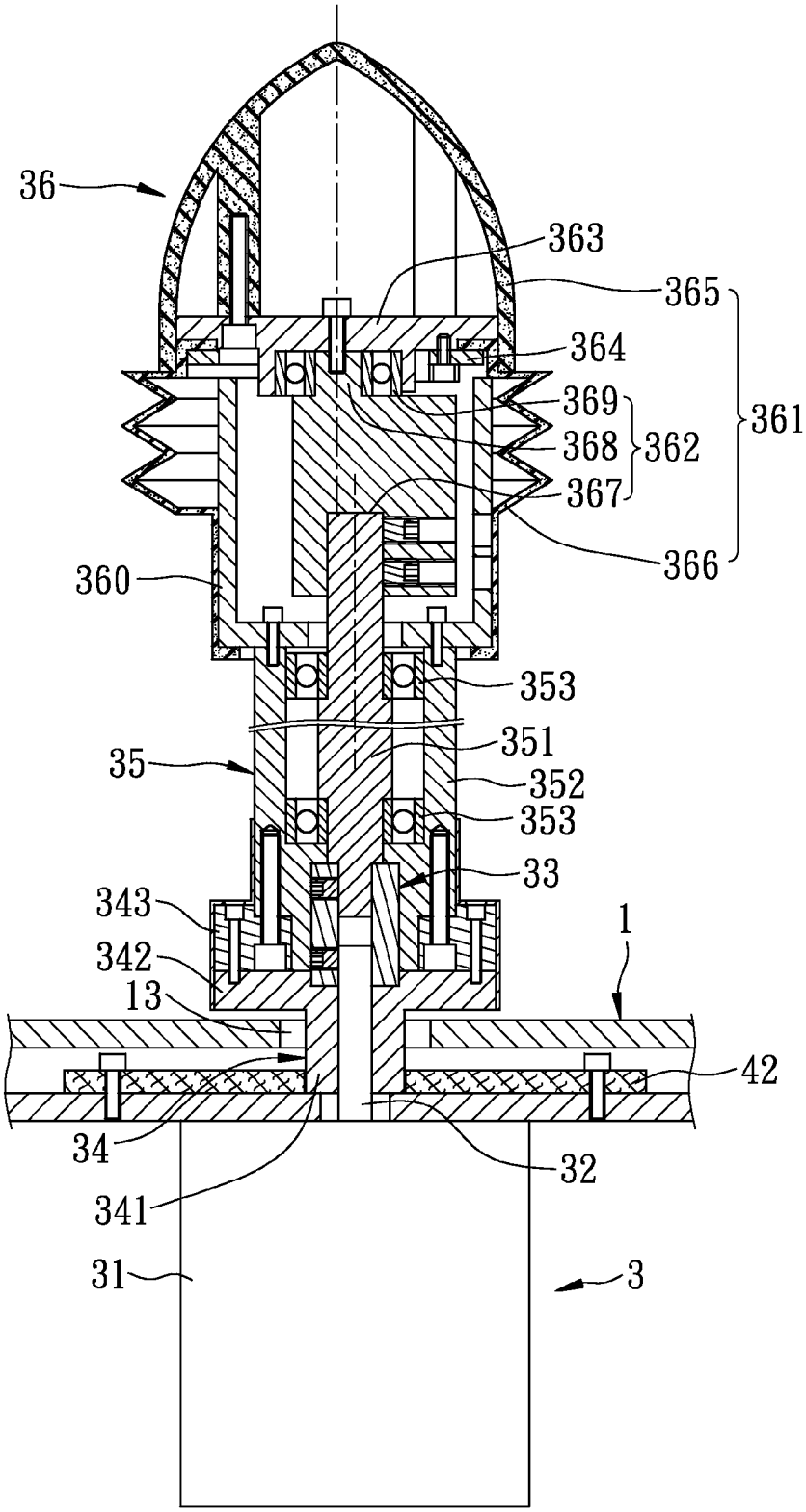
FIG. 5 is a fragmentary sectional view for illustrating a massage unit of the preferred embodiment.

Referring to FIGS. 3 and 5, the massage unit 3 includes a massage motor 31 that is connected co-movably to the moving seat 22 and that has a rotating shaft 32 projecting forwardly through the elongated groove 13, a head portion 36 that is connected eccentrically to and driven by the rotating shaft 32, a support member 34 that is connected securedly to the moving seat 22, that extends through and is movable along the elongated groove 13, and that surrounds the rotating shaft 32, and an extension member 35 that is disposed between the support member 34 and the head portion 36.

The support member 34 has a tubular securing portion 341 that is connected securedly to the moving seat 22 and that extends through and is movable along the elongated groove 13, an annular connecting portion 342 that extends radially and outwardly from the securing portion 341 and that has a width greater than that of the elongated groove 13, and a fixing portion 343 connected fixedly to the connecting portion 342 for installation of the extension member 35.

The extension member 35 includes an extension tube 352 that has one end connected to the fixing portion 343 of the support member 34 and an opposite end connected to the head portion 36, an extension shaft 351 that is connected co-rotatably to the rotating shaft 32, and that extends through and projects out of the extension tube 352, and a pair of spaced-apart bearings 353 disposed between the extension tube 352 and the extension shaft 351.

The massage unit 3 further includes a substantially tubular shaft coupling 33 that is disposed inside the extension tube 352 and that has opposite ends sleeved securely and respectively on the rotating shaft 32 and the extension shaft 351 for interconnecting co-rotatably the rotating shaft 32 and the extension shaft 351.

The extension shaft 351 is supported by the extension tube 352 through the bearings 353 and has one end connected to the shaft coupling 33. With the use of the shaft coupling 33, the extension shaft 351 is driven by the rotating shaft 32 and rotates about an axis thereof.

The head portion 36 includes an inner casing member 360 connected fixedly to the extension tube 352, a flexible slipcover 361 surrounding the inner casing member 360, a counterweight block 362 disposed in the inner casing member 360 and connected eccentrically and co-rotatably to the extension shaft 351, and a connecting plate 363 disposed inside and connected integrally to the slipcover 361. The counterweight block 362 is connected rotatably and eccentrically to the connecting plate 363 oppositely of the extension shaft 351. The head portion 36 further includes a clamping plate 364 connected to the connecting plate 363.

The slipcover 361 has a head piece 365 that is connected to the connecting plate 363 oppositely of the counterweight block 362 for being pressed by a user, and a bellow portion 366 that has one end clamped between the connecting plate 363 and the clamping plate 364, and that surrounds the inner casing member 360.

The counterweight block 362 has an input end 367 connected co-rotatably to the extension shaft 351, and an output end 368 that is eccentric with respect to the input end 367 and that is connected rotatably to the connecting plate 363. The head portion 36 further has a bearing unit 369 disposed between the counterweight block 362 and the connecting plate 363 to permit relative rotational movement between the counterweight block 362 and the connecting plate 363.

By virtue of the shaft coupling 33 and the extension shaft 351, the counterweight block 362 is driven co-rotatably by the rotating shaft 32. Moreover, since the input end 367 and the output end 368 are eccentric to each other, the connection between the connecting plate 363 and the output end 368 is able to drive the slipcover 361 to rotate eccentrically with respect to the rotating shaft 32.

Because the slipcover 361 is connected integrally to the connecting plate 363 and because the connecting plate 363 is connected rotatably to the output end 368, the headpiece 365 of the slipcover 361 is able to revolve about the input end 367 and will not rotate about an axis of its own.

Referring to FIGS. 2, 3 and 4 again, the protection unit 4 includes a pair of pulley sets 41 mounted to the support frame 1 and disposed respectively near the upper and lower ends of the elongated groove 13, and a protection belt 42 looping around the pulley sets 41 and covering the elongated groove 13. The protection belt 42 is connected co-movably to the moving seat 22. The rotating shaft 32 and the securing portion 341 extend through the protection belt 42.

Figure 8:
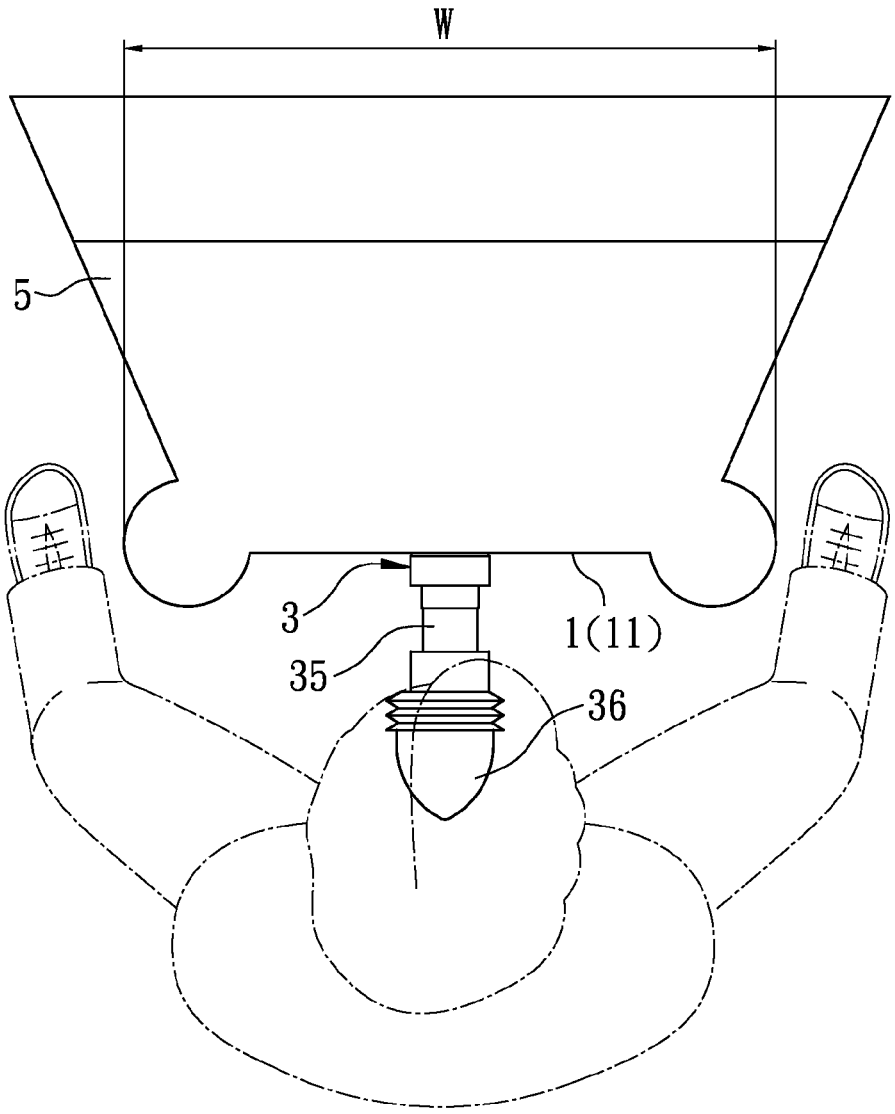
FIG. 8 is a top view showing the preferred embodiment in use.

The outer housing 5 surrounds the support frame 1, and has two opposite upright outer lateral walls 51 respectively facing outer surfaces of the side walls 12, a pair of column bodies 6 respectively connected to front ends of the outer lateral walls 51, a top wall 52 interconnecting top ends of the outer lateral walls 51 and the column bodies 6 above the support frame 1, a bottom wall 53 interconnecting bottom ends of the outer lateral walls 51 and the column bodies 6 and disposed below the side walls 12. Preferably, a distance (W) between outer borders of the column bodies 6 is smaller than 40 centimeters (see FIG. 8). The main wall 11 is disposed between and interconnects the column bodies 6. The front surface 111 of the main wall 11 is exposed from the outer housing 5.

The foot members 7 are attached to the bottom wall 53 and the column bodies 6, and are made of rubber for absorbing vibration and shock.

Figure 7:
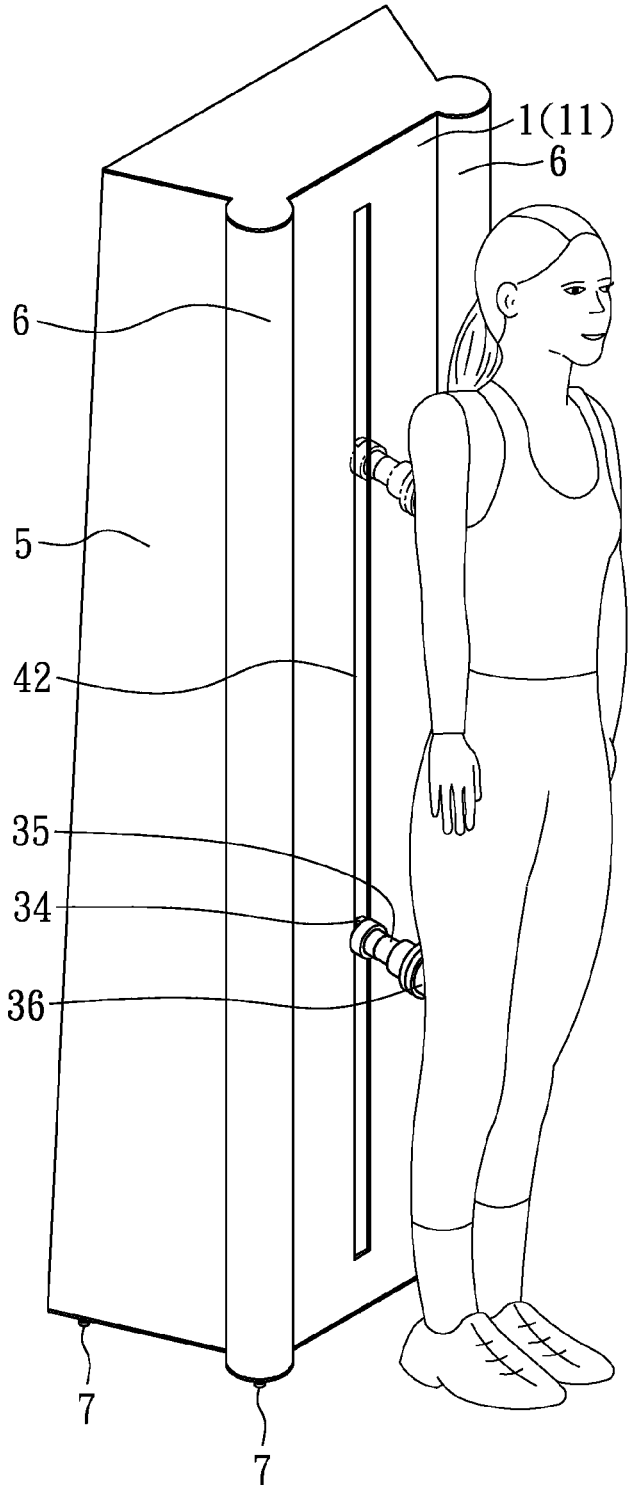
FIG. 7 is a perspective view showing the preferred embodiment in use.

A user can adopt different postures when using this massage apparatus. For example, the user may stand and lean against the head portion 36 (see FIG. 7), or sit and face the head portion 36 (see FIG. 8). Because the distance between the outer borders of the column bodies 6 is smaller than 40 cm, when the user sits for a massage, the massage apparatus may be placed between the legs of the user.

To sum up, the massage apparatus of this invention has several advantages.

Figure 1:
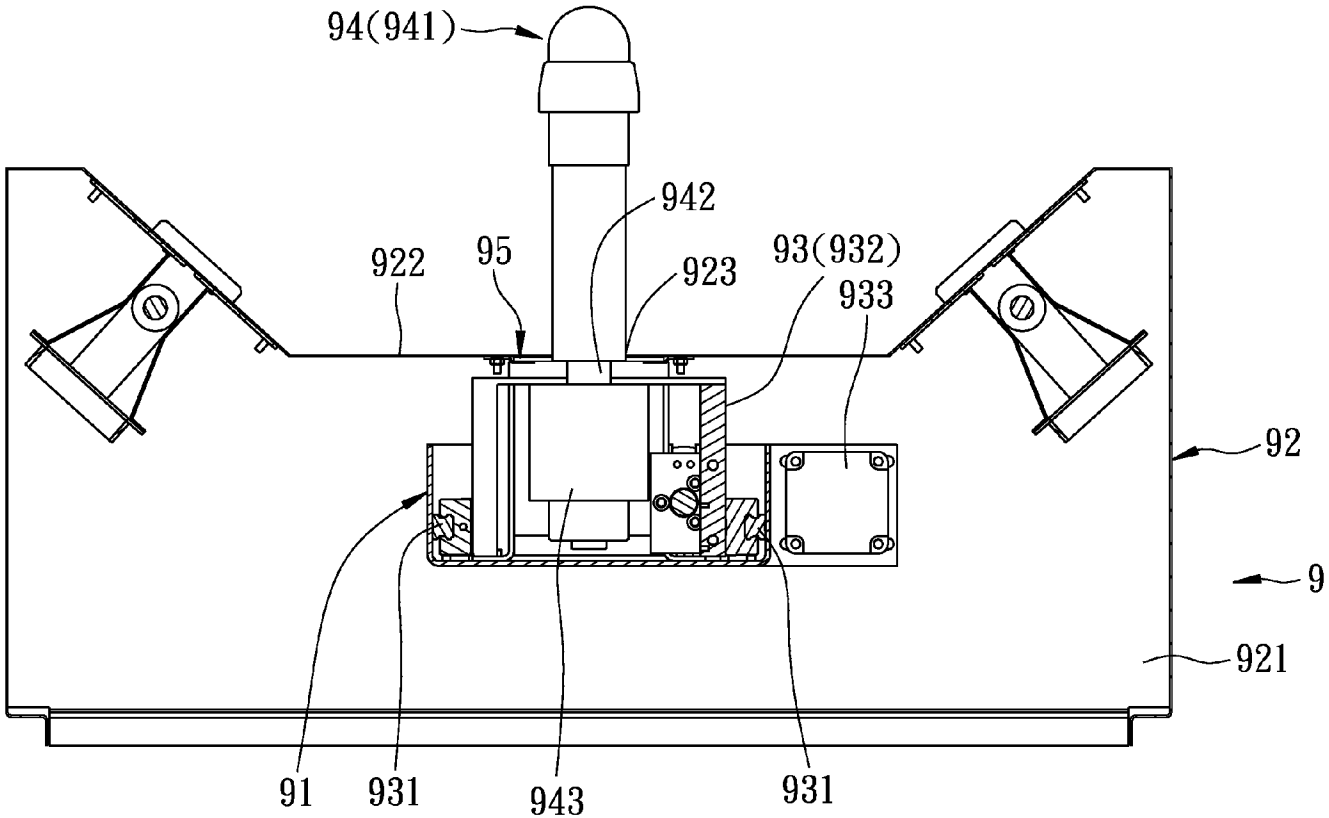
FIG. 1 PRIOR ART
FIG. 1 is a sectional view of a conventional massage apparatus.

1. The middle plate 221 of the moving seat 22 is close to the rear surface of the main wall 11 of the support frame 1, and the side plates 222 extends rearwardly from the middle plate 221, similar to the rearwardly extending side walls 12 of the support frame 1. The rotating shaft 32 extends forwardly through the elongated groove 13 formed in the main wall 11. The side plates 222 therefore have their supporting points (i.e., the guide rails 21) relatively close to the force application point on the head portion 36. Referring to FIG. 1, in the prior art, the middle part of the moving plate 932 is disposed in front of and far away from the main wall of the support frame 91, the side plates of the moving plate 932 extend rearwardly, unlike the frontwardly extending side walls of the support frame 91, the rotating shaft 942 extends frontwardly through the surrounding wall 922, rather than through the main wall of the support frame 91, and the massage motor 943 is disposed between the main wall of the support frame 91 and the middle part of the moving plate 932. Compared to the prior art, the distance between the force application point on the head portion 36 and the supporting point of the moving seat 22 in the present invention is reduced. Therefore, even when the head portion 36 is pressed by the user with a large force, accidental wobbling of the head portion 36 and the moving seat 22 is reduced.

2. The guide rails 21 are staggered and arranged at different distances from the main wall 11, and the slider members 223 are staggered and arranged at different heights. Owing to the staggered arrangement, torques generated during the operation of the massage apparatus may interact with each other and become balanced, thereby increasing stability of the moving seat 22 and reducing noises during the operation of the massage apparatus.

3. The support member 34 is slidable along the elongated groove 13 and is sleeved on the rotating shaft 32 to narrow the gap permitting the rotating shaft 32 to wobble within the elongated groove 13. In addition, the extension shaft 351 of the extension member 35 is used to shorten the length of the rotating shaft 32. As a result, the vibrational amplitude of the rotating shaft 32 is reduced, and the occurrence of hitting the main wall 11 and generating noises is reduced. In addition, with the use of the extension tube 352 that supports the extension shaft 351 and that is secured to the support member 34 and the head portion 36, stability of the rotating shaft 32 is improved, an entire structure of the massage unit 3 is strengthened, and a service life of the massage apparatus is lengthened.

4. The resilient member 28 is sleeved on the non-threaded rod portion 252 of the screw rod 25 and abuts against the threaded rod portion 251 and one of the end plates 14 to absorb thermal expansion or manufacturing tolerance of the screw rod 25. When in use, the screw rod 25 may have less vertical vibration and noise.

5. The vibrating action of the main wall 11 is similar to that of the moving seat 22, so that the protection belt 42 does not easily hit the main wall 11 to create annoying noise.

6. Because the column bodies 6 of the outer housing 5 are connected respectively to two opposite sides of the main wall 11, the differential vibration between the main wall 11 and the outer housing 5 is reduced.

7. The main wall 11 is exposed at a front side of the outer housing 5, and the outer housing 5 does not need to enclose an entire structure of the support frame 1. Accordingly, the size of the massage apparatus is reduced.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A massage apparatus comprising:

an upright support frame having a U-shaped cross-section and including an upright main wall that has opposite front and rear surfaces, a pair of upright side walls, each of which is connected to a respective one of two opposite edges of said main wall and that extends rearwardly away from said main wall, and an upright elongated groove that is formed through said front and rear surfaces of said main wall;

a moving unit disposed in said support frame and including a pair of upright guide rails that are mounted respectively on said side walls, and a moving seat that is connected slidably to said guide rails and that is movable along said guide rails, said moving seat having a middle plate that faces toward and that is close to said rear surface of said main wall, a pair of side plates that are connected respectively to two opposite ends of said middle plate and that extend rearwardly away from said middle plate, and a pair of slider members that are disposed respectively on said side plates and that engage respectively and slidably said guide rails; and a massage unit including a massage motor that is connected co-movably to said moving seat and that has a rotating shaft projecting out of said support frame through said elongated groove, and a head portion that is connected eccentrically to and driven by said rotating shaft;

wherein said massage unit further includes a support member connected securedly to said moving seat, extending through and movable along said elongated groove, and surrounding said rotating shaft, and an extension member disposed between said support member and said head portion, and having an extension tube that has one end connected to said support member and an opposite end connected to said head portion, and an extension shaft that is connected co-rotatably to said rotating shaft, and that extends through and proiects out of said extension tube;

wherein said head portion of said massage unit has a counterweight block connected eccentrically and co-rotatably to said extension shaft, and a flexible slipcover connected to said extension tube and surrounding said counterweight block; and wherein said head portion of said massage unit further has a connecting plate that is disposed inside and connected integrally to said slipcover, said connecting plate being connected rotatably and eccentrically to said counterweight block oppositely of said extension shaft.

2. The massage apparatus as claimed in claim 1, wherein a distance between one of said guide rails and said main wall is different from that between the other one of said guide rails and said main wall.

3. The massage apparatus as claimed in claim 1, wherein said slider members of said moving seat are different in altitude.

4. The massage apparatus as claimed in claim 1, wherein said support member is disposed between said massage motor and said head portion.

5. The massage apparatus as claimed in claim 1, wherein:

said head portion of said massage unit further has a clamping plate that is connected to said connecting plate; and said slipcover has a head piece that is connected to said connecting plate oppositely of said counterweight block for making contact with a user, and a bellow portion that has one end clamped between said connecting plate and said clamping plate, and surrounds said counterweight block.

6. The massage apparatus as claimed in claim 5, wherein said massage unit further includes a shaft coupling disposed inside said extension tube and having opposite ends that are sleeved securely and respectively on said rotating shaft and said extension shaft.

7. The massage apparatus as claimed in claim 1, further comprising a protection unit that includes a pair of pulley sets disposed respectively near upper and lower ends of said elongated groove, and a protection belt looping around said pulley sets, covering said elongated groove, and connected co-movably to said moving seat, said rotating shaft extending through said protection belt.

8. The massage apparatus as claimed in claim 1, wherein:

said support frame further includes two end plates disposed respectively above an upper end of said elongated groove and below a lower end of said elongated groove, each of said end plates bridging and connecting said side walls; and said moving unit further includes a driving motor provided on one of said end plates, an elongated screw rod having upper and lower ends that respectively extend through said end plates, one of said upper and lower ends of said screw rod being rotated by said driving motor, and a driven member connected co-movably to said moving seat and disposed engagedly around said screw rod, rotation of said screw rod driving said driven member and said moving seat to move upwardly and downwardly along said screw rod.

9. The massage apparatus as claimed in claim 8, wherein said screw rod of said moving unit further has an elongated threaded rod portion and a non-threaded rod portion connected to one end of said threaded rod portion, said moving unit further including a resilient member that is sleeved on said non-threaded rod portion and that has opposite ends respectively abutting against said threaded rod portion and a proximal one of said end plates.

10. The massage apparatus as claimed in claim 1, further comprising:

an outer housing surrounding said support frame, and having two opposite upright outer lateral walls that respectively face outer surfaces of said side walls, a pair of column bodies, each of which is connected to one end of a respective one of said outer lateral walls, a top wall that interconnects top ends of said outer lateral walls and said column bodies above said support frame, a bottom wall that interconnects bottom ends of said outer lateral walls and said column bodies, and that is disposed below said side walls, said main wall being disposed between and interconnecting said column bodies, said front surface of said main wall being exposed from said outer housing; and a plurality of foot members attached to said bottom wall.

* * * * *